US009151127B1

(12) United States Patent
Branton

(10) Patent No.: US 9,151,127 B1
(45) Date of Patent: Oct. 6, 2015

(54) ON/OFF TOOL RUNNING AND WELL COMPLETION METHOD AND ASSEMBLY

(76) Inventor: Christopher A. Branton, Bossier City, LA (US)

( * ) Notice: Subject to any disclaimer, the term of this patent is extended or adjusted under 35 U.S.C. 154(b) by 707 days.

(21) Appl. No.: 13/374,403

(22) Filed: Dec. 27, 2011

(51) Int. Cl.
*E21B 23/02* (2006.01)
*E21B 23/00* (2006.01)

(52) U.S. Cl.
CPC ..... *E21B 23/004* (2013.01); *E21B 23/02* (2013.01)

(58) Field of Classification Search
CPC ..... E21B 23/004; E21B 23/02; E21B 23/03; E21B 23/01; E21B 17/06
USPC ..... 166/255.1, 387, 250.4, 373, 382, 311, 166/332.1, 242.7, 380
See application file for complete search history.

(56) References Cited

U.S. PATENT DOCUMENTS

| | | | | |
|---|---|---|---|---|
| 4,749,036 | A * | 6/1988 | Read | 166/143 |
| 4,942,925 | A * | 7/1990 | Themig | 166/382 |
| 5,197,547 | A * | 3/1993 | Morgan | 166/387 |
| 5,791,413 | A * | 8/1998 | Buzinsky | 166/123 |
| 2008/0042870 | A1 * | 2/2008 | Orban et al. | 340/854.2 |
| 2010/0243325 | A1 * | 9/2010 | Veeningen | 175/40 |

* cited by examiner

*Primary Examiner* — Jennifer H Gay
*Assistant Examiner* — David Carroll
(74) *Attorney, Agent, or Firm* — R. Keith Harrison

(57) ABSTRACT

An on/off tool running and well completion method includes deploying a packer in a well bore; providing an assembly having an on/off tool and a tool spacer sleeve carried by the on/off tool; providing a tubing string; coupling the on/off tool of the assembly to the tubing string; inserting the assembly and the tubing string in the well bore; irrigating the packer by circulating packer fluid through the well bore, the assembly and the tubing string to clean the packer; determining a depth of the packer in the well bore; and latching the on/off tool of the assembly to the packer once.

14 Claims, 11 Drawing Sheets

ON/OFF TOOL RUNNING AND WELL COMPLETION METHOD AND ASSEMBLY

FIELD

Embodiments of the disclosure generally relate to methods of completing hydrocarbon production wells. More particularly, embodiments of the disclosure relate to an on-off tool running and well completion method and assembly in which seals in an on/off tool are protected from abrasion as the tool is coupled to a packer deployed in a hydrocarbon well preparatory to completion of the well.

BACKGROUND

In the completion of hydrocarbon wells, it is common practice to isolate one or more subterranean hydrocarbon-producing formation zones from each other within a well bore using packers. Conventional practice may include deploying a packer with a seal stinger or seal bore at a desired depth within the well bore using a hydraulic setting tool on a wireline, tubing string or the like. After the hydraulic setting tool is next retrieved from the well, an on/off tool may be lowered into the well bore on a tubing string, slid over the stinger and latched onto the top of the packer. A set of seals is typically seated inside the on/off tool to impart a fluid-tight seal between the tool and the stinger as the tool slides over the stinger and latches onto the packer.

After the on/off tool is latched to the packer, downward pressure may be applied to the tubing string to compress the tubing and approximate the compression dynamics of the production string. The compressed tubing string may then be marked at the well surface to indicate the approximate depth of the packer in the well bore. Next, the on/off tool may be unlatched from the packer and the tubing string retrieved from the well bore. The number and length of the subs in the production string may be "spaced out" or taken into account to determine the number of joints to be used in the production string according to the depth of the packer as indicated by the mark on the tubing string. Finally, the production string may be assembled at the well surface and an on/off tool coupled to the production string and inserted into the well bore until the on/off tool lands on the packer and is coupled thereto typically by rotation of the production string. A Christmas tree may then be assembled at the well surface to complete the well and hydrocarbons produced from the production string through the Christmas tree.

One of the drawbacks inherent in the conventional method of latching the on/off tool to the packer during the procedure of marking the packer depth on the tubing string is that mud, sand and other sediments tend to settle on the top of the packer and the stinger as the packer is deployed in the well bore. The presence of the sediments on top of the packer and the stinger may impede latching of the on/off tool to the packer. Consequently, repeated attempts may be required to successfully conclude the latching and marking operation as the on/off tool is raised and lowered on the stinger and makes repeated contact with the top of the packer. As the on/off tool repeatedly slides over the stinger during these attempts, the sediments tend to abrade or erode and damage the seals, necessitating frequent replacement of the seals.

SUMMARY

Illustrative embodiments of the disclosure are generally directed to an on/off tool running and well completion method. An illustrative embodiment of the method includes deploying a packer in a well bore; providing an assembly having an on/off tool and a tool spacer sleeve carried by the on/off tool; providing a tubing string; coupling the on/off tool of the assembly to the tubing string; inserting the assembly and the tubing string in the well bore; irrigating the packer by circulating packer fluid through the well bore, the assembly and the tubing string to clean the packer; determining a depth of the packer in the well bore; and latching the on/off tool of the assembly to the packer once.

Embodiments of the disclosure are further generally directed to an on/off tool running and well completion assembly for a tubing string. An illustrative embodiment of the assembly includes an on/off tool adapted for attachment to the tubing string, a tool spacer sleeve telescopically receiving the on/off tool and at least one breakable connection normally securing the on/off tool and the tool spacer sleeve in stationary relationship with respect to each other.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
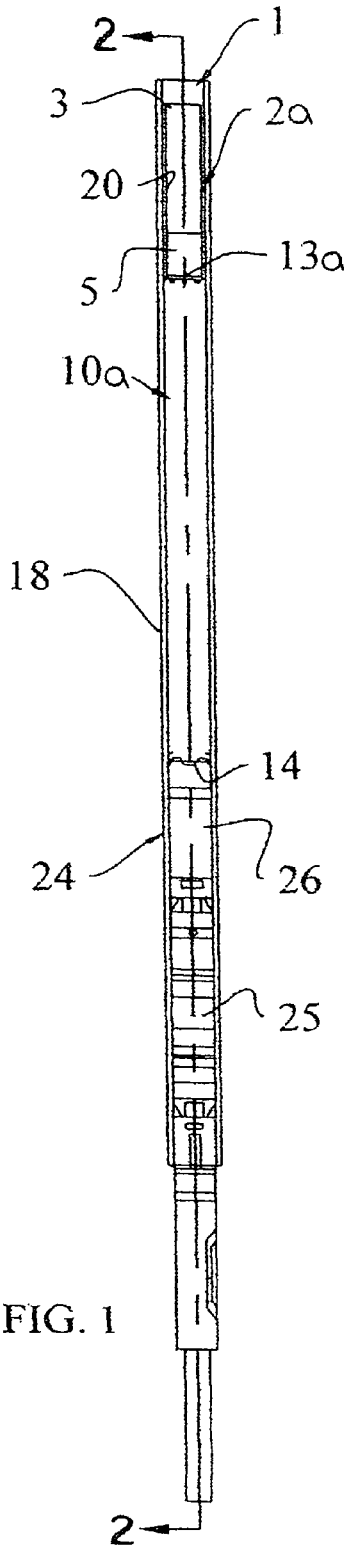
FIG. 1 is a side view of an illustrative embodiment of an on/off tool running and well completion assembly inserted in a well casing (in longitudinal sectional view), with an on/off tool of the assembly unlatched from a packer deployed in the well casing.
Figure 2:
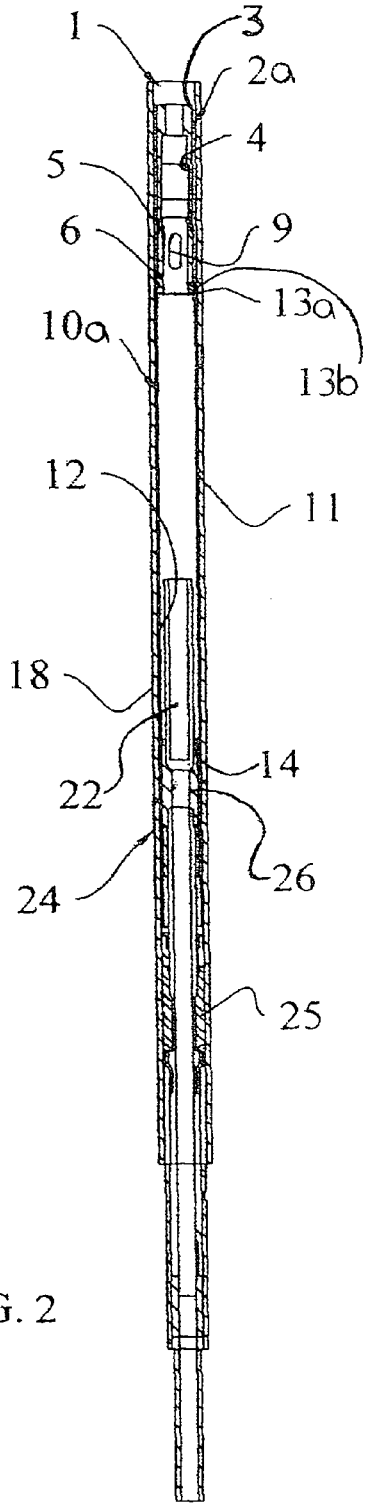
FIG. 2 is a longitudinal sectional view of the on/off tool running and well completion assembly, inserted in the well casing (also in longitudinal sectional view) with the on/off tool of the assembly unlatched from the packer.
Figure 3:
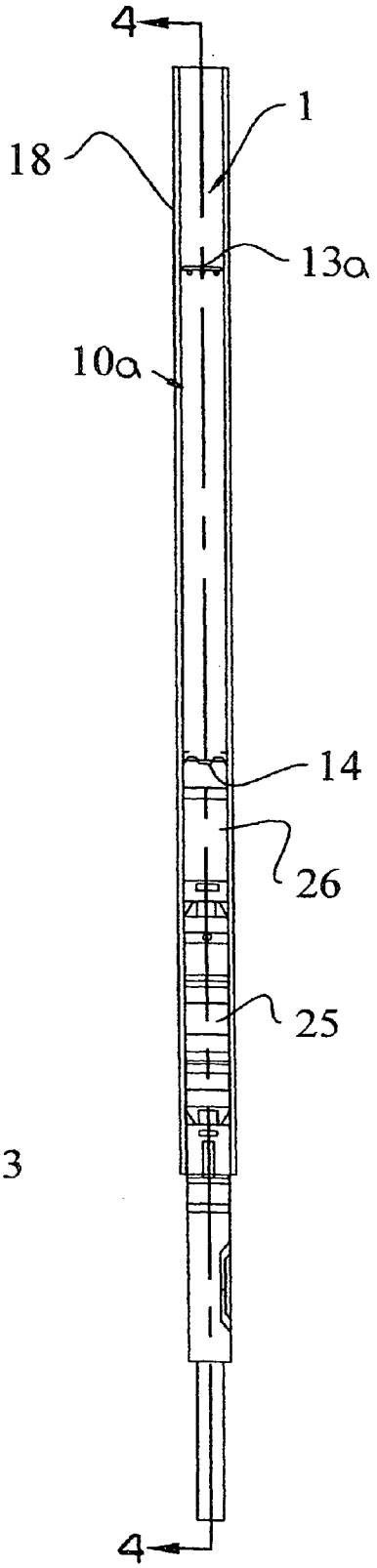
FIG. 3 is a side view of the on/off tool running and well completion assembly inserted in the well casing (in longitudinal sectional view), with the on/off tool (not illustrated) of the assembly latched to the packer.
Figure 4:
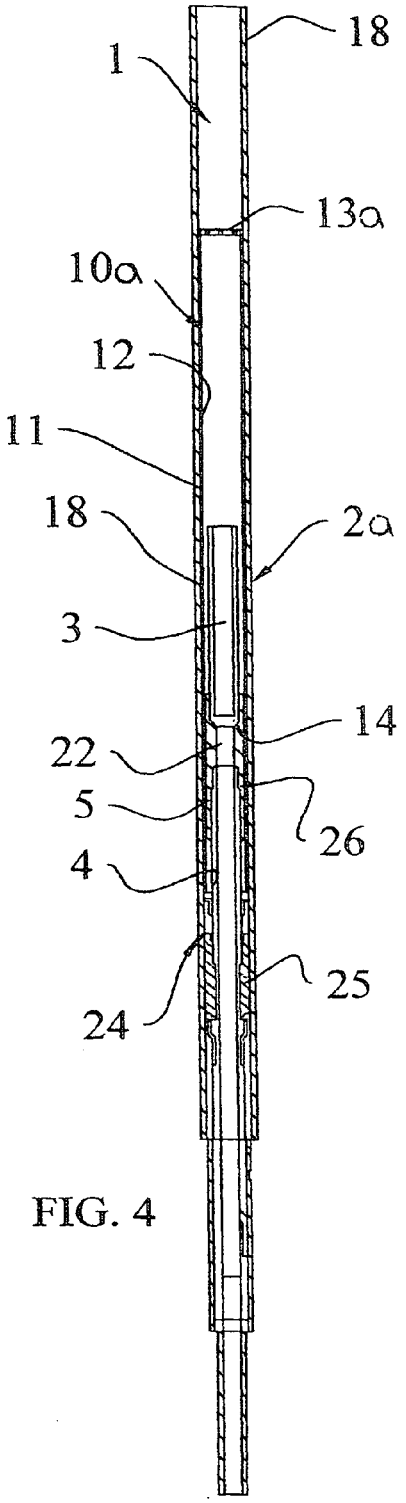
FIG. 4 is a longitudinal sectional view of the on/off tool running and well completion assembly, inserted in the well casing (also in longitudinal sectional view) with the on/off tool of the assembly latched to the packer.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is non-limiting and is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "upper", "lower", "above", "below", "top", "horizontal" and "vertical" as used herein are intended for descriptive purposes only and are not necessarily intended to be construed in a limiting sense.

Referring initially to FIGS. 1-8 of the drawings, an illustrative embodiment of the on/off tool running and well completion assembly, hereinafter assembly, is generally indicated by reference numeral 1. The assembly 1 is shown inserted in a well casing 18 of a subterranean hydrocarbon production well 17 (FIGS. 9-15) in exemplary implementation of the on/off tool running and well completion method, hereinafter method, which will be hereinafter described. Accordingly, a packer assembly 24 which may have a conventional design typically includes a retrievable packer 25 deployed in the well casing 18 to isolate adjacent hydrocarbon production zones (not illustrated) from each other in the well casing 18, typically in the conventional manner, prior to completion of the well 17. The packer 25 may be fitted with a packer top sub 26 and a packer stinger 22 which extends from the packer top sub 26. It will be recognized and understood that while the on/off tool running and well completion assembly and method will be described herein with reference to a vertical subterranean hydrocarbon production well 17, the assembly and method are equally applicable to horizontal and other non-vertical wells in which such designations as "top", "bottom", "upper" and "lower" may not necessarily apply.

Figure 6:
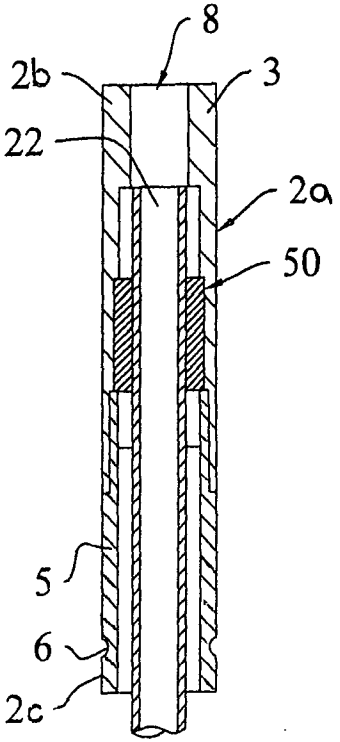
FIG. 6 is a longitudinal sectional view of the on/off tool and the packer stinger with the stinger extending through the seal pack as the on/off tool is slid over the stinger and coupled to the packer (not illustrated)
Figure 5:
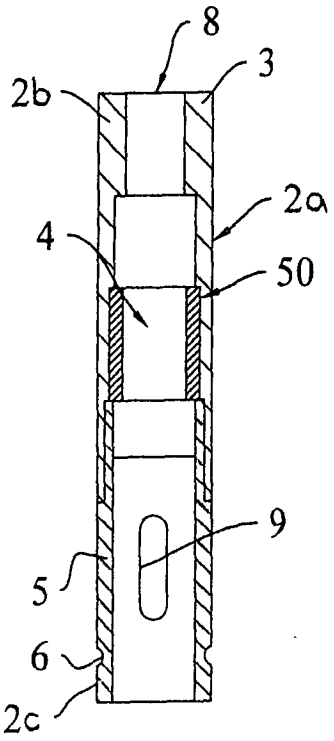
FIG. 5 is a longitudinal sectional view of the on/off tool with a seal pack seated in a seal cavity in the on/off tool.

The assembly 1 includes an on/off tool 2*a*. As illustrated in FIGS. 5 and 6, the on/off tool 2*a* has a tool wall 2*b* which may be generally elongated and cylindrical and is traversed by a tool bore 8. The tool wall 2*b* may include an upper tool top sub 3 and a lower stinger connection portion 5. In implementation of the method, which will be hereinafter described, the tool top sub 3 facilitates connection of the on/off tool 2*a* to a production string 28*a* (FIGS. 10-15) and the stinger connection portion 5 facilitates coupling of the on/off tool 2*a* to the packer stinger 22 (FIGS. 1-4) on the packer 25. The on/off tool 2*a* may additionally include at least one exterior pin seat 6 which may be generally at the lower portion of the stinger connection portion 5 for purposes which will be hereinafter described. A circumferential tool lip 2*c* may extend from the exterior surface of the tool wall 2*b*, generally adjacent to the pin seat or seats 6, for purposes which will be hereinafter described. In some embodiments, a pair of diametrically-opposed stinger slots 9 may be provided in the stinger connection portion 5 of the on/off tool 2*a* to facilitate attachment of the on/off tool 2*a* to the packer stinger 22 (FIGS. 2 and 4) as will be hereinafter described. A seal cavity 4 may be included in the tool bore 8 of the on/off tool 2*a* generally between the tool top sub 3 and the stinger connection portion 5.

As further illustrated in FIGS. 5 and 6, a seal pack 50 is seated in the seal cavity 4 of the on/off tool 2*a*. As illustrated in FIG. 6, in implementation of the method, the seal pack 50 receives the packer stinger 22 as the on/off tool 2*a* approaches the packer top sub 26 (FIGS. 1-4) of the packer 25 preparatory to latching of the on/off tool 2*a* to the packer stinger 22. The seal pack 50 imparts a fluid-tight and gas-tight seal between the interior surface of the on/off tool 2*a* and the exterior surface of the packer stinger 22. The design and composition of the seal pack 50 resist abrasion imparted by sediments which may be present on the packer stinger 22 and/or the packer top sub 26 as the on/off tool 2*a* descends on the packer stinger 22.

Figure 8:
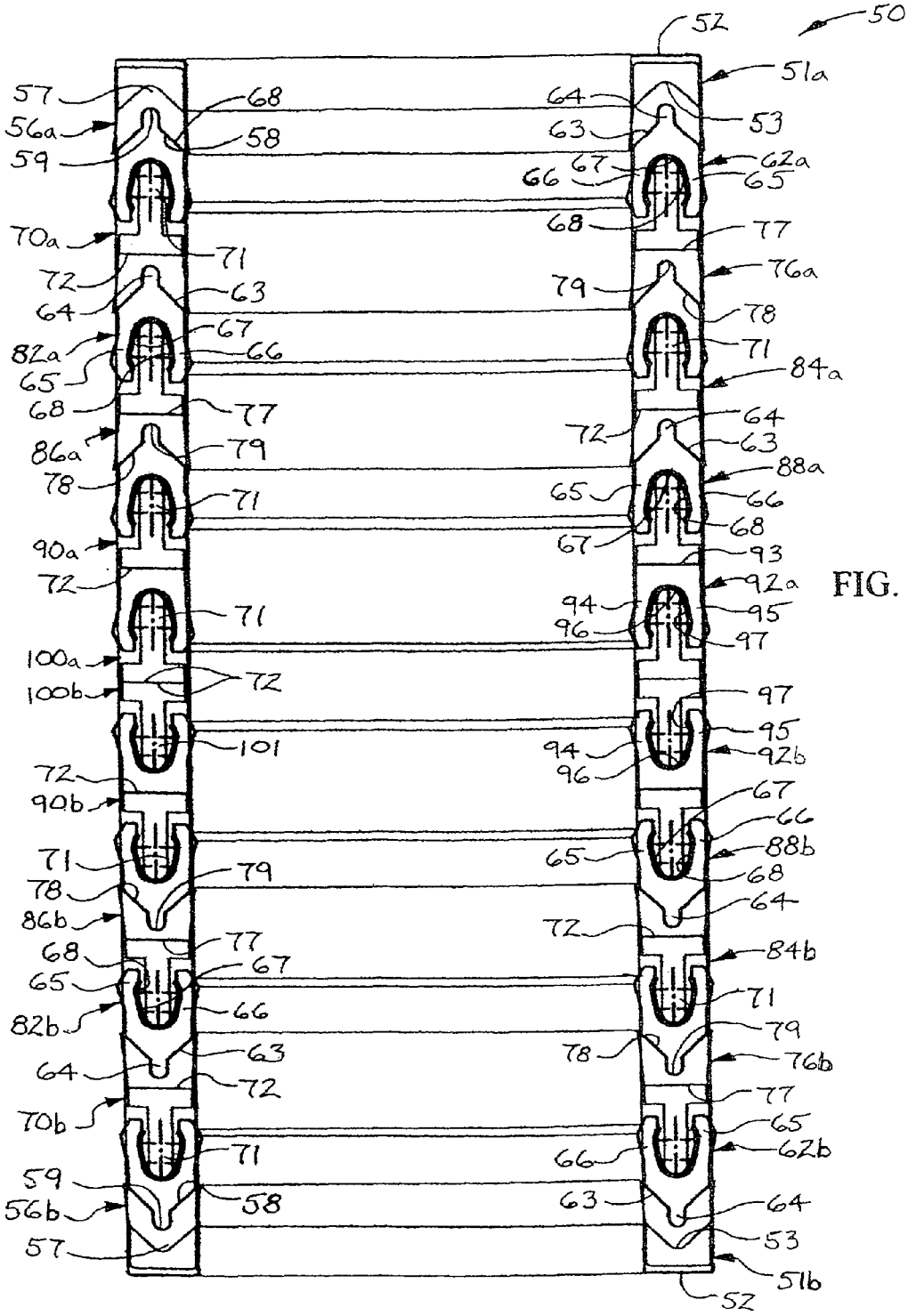
FIG. 8 is a sectional view of an exemplary seal pack which is suitable for the on/off tool in an illustrative embodiment of the on/off tool running and well completion assembly.

An exemplary seal pack 50 which is suitable for the on/off tool 2*a* is illustrated in FIG. 8. The seal pack 50 may include a pair of outer backup seals 51*a*, 51*b* at opposite ends of the seal pack 50. Each outer backup seal 51*a*, 51*b* may have a generally flat or planar, annular outer seal surface 52 and an annular inner seal groove 53 which may have a generally V-shaped cross-section. In some embodiments, each outer backup seal 51*a*, 51*b* may include corrosion-resistant steel, for example and without limitation.

Outer V-packing seals 56*a*, 56*b* may seat against the respective outer backup seals 51*a*, 51*b*. Each outer V-packing seal 56*a*, 56*b* may include an annular outer seal lip 57 which inserts in the companion seal groove 53 of the corresponding outer backup seal 51*a*, 51*b*. Each outer V-packing seal 56*a*, 56*b* may also include a pair of concave, angled or tapered inner seal surfaces 58 and an annular seal groove 59 which is at the inner terminus of the inner seal surfaces 58 and may have a generally U-shaped cross-section. In some embodiments, each V-packing seal 56*a*, 56*b* may include virgin PEEK (polyether ether ketone), for example and without limitation.

Jacket seals 62*a*, 62*b* may seat against the respective outer V-packing seals 56*a*, 56*b*. Each jacket seal 62*a*, 62*b* may include a pair of convex tapered outer jacket seal surfaces 63 which engage the respective inner seal surfaces 58 of the corresponding V-packing seal 56*a*, 56*b*. An annular jacket seal lip 64 may extend from the outer jacket seal surfaces 63 and inserts in the companion inner seal groove 59 of the corresponding outer V-packing seal 56*a*, 56*b*. Each jacket seal 62*a*, 62*b* may further include an annular outer jacket seal wall 65, an annular inner jacket seal wall 66 and an annular seal groove 67 which is between the outer jacket seal wall 65 and the inner jacket seal wall 66 and may have a generally U-shaped cross-section. A seal groove spring 68 may line the interior surface of the seal groove 67. In some embodiments, each jacket seal 62*a*, 62*b* may include PTFE (polytetrafluoroethylene), for example and without limitation. Each seal groove spring 68 may be nickel-cobalt alloy, for example and without limitation.

Seal rings 70*a*, 70*b* may seat against the respective jacket seals 62*a*, 62*b*. Each Seal ring 70*a*, 70*b* may include an annular ring seal lip 71 which inserts into the companion seal groove 67 of the corresponding jacket seal 62*a*, 62*b* and an annular inner seal surface 72 which may be generally flat or planar. In some embodiments, each seal ring 70*a*, 70*b* may include corrosion-resistant steel, for example and without limitation.

Backup seals 76*a*, 76*b* may seat against the respective seal rings 70*a*, 70*b*. Each backup seal 76*a*, 76*b* may include a generally flat or planar, annular outer seal surface 77 which engages the inner seal surface 72 of the corresponding seal ring 70*a*, 70*b*. Each backup seal 76*a*, 76*b* may further include a pair of annular, concave, tapered inner seal surfaces 78 and an annular seal groove 79 which is at the inner terminus of the inner seal surfaces 78 and may have a generally U-shaped cross-section. In some embodiments, each middle jacket seal 76*a*, 76*b* may include virgin PEEK, for example and without limitation.

Jacket seals 82*a*, 82*b* may seat against the respective backup seals 76*a*, 76*b*. Each jacket seal 82*a*, 82*b* may have a construction and composition which are the same as or similar to those of the jacket seals 62*a*, 62*b*, where like reference numerals designate like elements. The jacket seal lip 64 of each jacket seal 82*a*, 82*b* may insert into the companion seal groove 79 of the corresponding backup seal 76*a*, 76*b*.

Seal rings 84*a*, 84*b* may seat against the respective jacket seals 82*a*, 82*b*. Each seal ring 84*a*, 84*b* may have a construction and composition which are the same as or similar to those of the seal rings 70*a*, 70*b*, where like reference numerals designate like elements. The ring seal lip 71 of each seal ring 84*a*, 84*b* may insert into the companion seal groove 67 of the corresponding adjacent jacket seal 82*a*, 82*b*.

Backup seals 86*a*, 86*b* may seat against the respective seal rings 84*a*, 84*b*. Each backup seal 86*a*, 86*b* may have a construction and composition which are the same as or similar to those of the backup seals 76*a*, 76*b*, where like reference numerals designate like elements. The outer seal surface 77 of each backup seal 86*a*, 86*b* may engage the inner seal surface 72 of the corresponding adjacent seal ring 84*a*, 84*b*.

Jacket seals 88*a*, 88*b* may seat against the respective backup seals 86*a*, 86*b*. Each jacket seal 88*a*, 88*b* may have a construction and composition which are the same as or similar to those of the jacket seals 82*a*, 82*b*, where like reference numerals designate like elements. The jacket seal lip 64 of each jacket seal 88*a*, 88*b* may insert into the companion seal groove 79 of the corresponding adjacent backup seal 86*a*, 86*b*.

Seal rings 90*a*, 90*b* may seat against the respective jacket seals 88*a*, 88*b*. Each seal ring 90*a*, 90*b* may have a construction and composition which are the same as or similar to those of the seal rings 84*a*, 84*b*, where like reference numerals designate like elements. The ring seal lip 71 of each seal ring 90*a*, 90*b* may insert into the companion seal groove 67 of the corresponding jacket seal 88*a*, 88*b*.

Innermost jacket seals 92*a*, 92*b* may seat against the respective seal rings 90*a*, 90*b*. Each innermost jacket seal 92*a*, 92*b* may have a generally flat or planar, annular outer seal surface 93 which engages the inner seal surface 72 of the corresponding seal ring 70*a*, 70*b*. Each innermost jacket seal 92*a*, 92*b* may further include an annular inner seal wall 94, an annular outer seal wall 95 and an annular seal groove 96 between the inner seal wall 94 and the outer seal wall 95. An annular seal groove spring 97 may line the interior surface of the seal groove 96. In some embodiments, each innermost jacket seal 92*a*, 92*b* may include PTFE (polytetrafluoroethylene), for example and without limitation. Each seal groove spring 97 may include nickel-cobalt alloy, for example and without limitation.

Innermost seal rings 100*a*, 100*b* may seat against the respective innermost jacket seals 92*a*, 92*b*. Each innermost seal ring 100*a*, 100*b* may have a construction and composition which are the same as or similar to those of the seal rings 84*a*, 84*b*, where like reference numerals designate like elements. The ring seal lip 71 of each seal ring 100*a*, 100*b* may insert into the companion seal groove 96 of the corresponding innermost jacket seal 92*a*, 92*b*. The inner ring surface 72 of each innermost seal ring 100*a*, 100*b* may engage the inner ring surface 72 of the adjacent innermost seal ring 100*a*, 100*b*.

It will be appreciated by those skilled in the art that the seal pack 50 may include at least one pair of jacket seals, at least one pair of seal rings and at least one pair of backup seals, respectively. Therefore, it will be recognized and understood that the foregoing described arrangement and number of the jacket seals, the seal rings and the backup seals in the seal pack 50 serves as a non-limiting example among many possible arrangements of these elements in the seal pack 50. In some non-limiting illustrative embodiments, one or more pairs of the jacket seals, the seal rings and the backup seals may be omitted from the seal pack 50. In still other embodiments, the seal pack 50 may include additional pairs of the jacket seals, the seal rings and the backup seals.

Figure 7D:
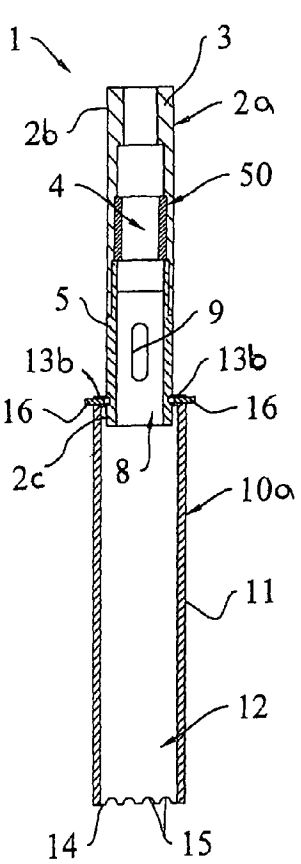
FIG. 7D is a longitudinal sectional view of the tool spacer sleeve unpinned from the on/off tool and suspended from the on/off tool as the on/off tool and the tool spacer sleeve of the assembly are removed from a well bore (not illustrated)
Figure 7C:
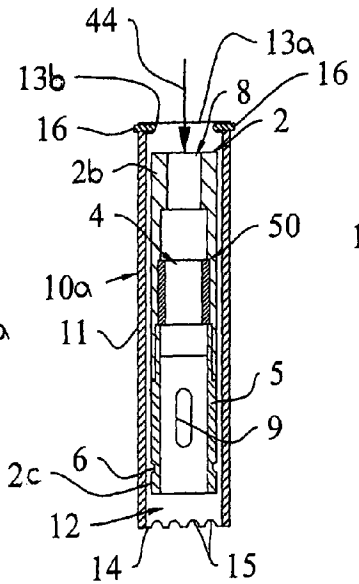
FIG. 7C is a longitudinal sectional view of the tool spacer sleeve unpinned from the on/off tool and the on/off tool positioned inside the tool spacer sleeve in implementation of the on/off tool running and well completion method.
Figure 7B:
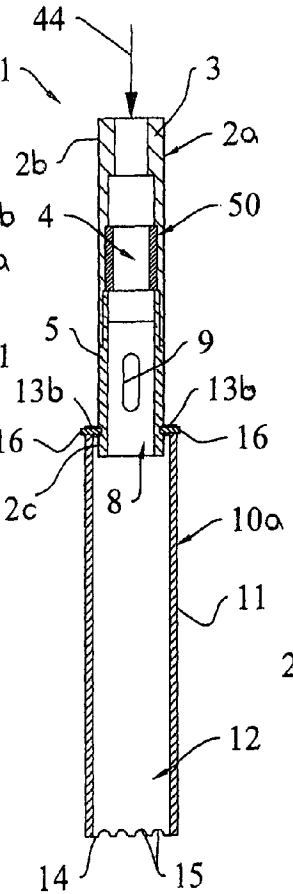
FIG. 7B is a longitudinal sectional view of a tool spacer sleeve pinned to an on/off tool (also in longitudinal sectional view) according to an illustrative embodiment of the on/off tool running and well completion assembly and method.
Figure 7A:
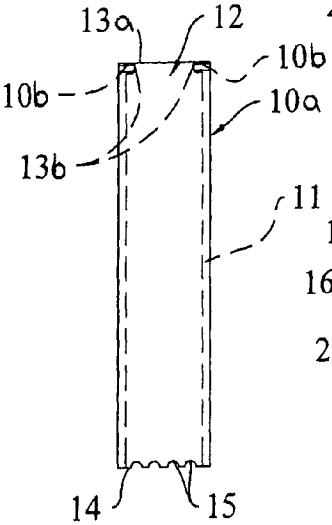
FIG. 7A is a side view of an exemplary tool spacer sleeve according to an illustrative embodiment of the on/off tool running and well completion assembly and method.

As illustrated in FIGS. 7A-7D of the drawings, the assembly 1 further includes a tool spacer sleeve 10*a* which is initially attached to the on/off tool 2*a* through at least one breakable connection, as illustrated in FIG. 7B, in implementation of the method. The tool spacer sleeve 10*a* includes a spacer sleeve wall 11 which may be generally elongated and cylindrical and has an upper sleeve end 13*a* and a lower sleeve end 14. A spacer sleeve bore 12 traverses the spacer sleeve wall 11 from the upper sleeve end 13*a* to the lower sleeve end 14. A sleeve lip 13*b* may protrude from the inner surface of the spacer sleeve wall 11 into the spacer sleeve bore 12 generally at the sleeve upper end 13*a*. At least one fluid flow notch 15 may be provided in the sleeve lower end 14 for purposes which will be hereinafter described.

As illustrated in FIG. 7B, in implementation of the method, the on/off tool 2*a* is initially attached to the tool spacer sleeve 10*a* through at least one breakable connection which normally secures the on/off tool 2*a* in stationary relationship with respect to the tool spacer sleeve 10*a*. The on/off tool 2*a* may be partially disposed or telescopically received in the spacer sleeve bore 12 and protrude from the sleeve upper end 13*a*. The on/off tool 2*a* may be attached to the tool spacer sleeve 10*a* according to any breakable connection which is suitable for the purpose. In some embodiments, at least one pin seat 6 may be provided typically in the exterior surface of the stinger connection portion 5 of the on/off tool 2*a*. At least one pin opening 10*b* (FIG. 7A) may extend through the spacer sleeve wall 11 and the sleeve lip 13*b* of the tool spacer sleeve 10*a*. At least one sleeve pin 16 may extend through each pin opening 10*b* in the tool spacer sleeve 10*a* and is normally seated in the corresponding registering pin slot 6 in the on/off tool 2*a* to attach the on/off tool 2*a* to the tool spacer sleeve 10*a*. A tool seal (not illustrated) may be interposed between the exterior surface of the stinger connection portion 5 of the on/off tool 2*a* and the interior surface of the tool spacer sleeve 10*a*.

Also in implementation of the method, as will be hereinafter described, the on/off tool 2*a* is latched to the packer stinger 22 (FIGS. 1-4) of the packer 25. Accordingly, as illustrated in FIG. 7B, a predetermined magnitude of downward pressure 44 may be applied to the on/off tool 2*a* to shear the sleeve pins 16 (FIG. 7B) and displace the on/off tool 2*a* downwardly in the spacer sleeve bore 12, as illustrated in FIG. 7C, and onto the packer stinger 22 to latch the on/off tool 2*a* to the packer stinger 22. Alternative techniques other than the sleeve pins 16 which are known by those skilled in the art and consistent with the functional requirements of the assembly 1 may be used to attach the on/off tool 2*a* to the tool spacer sleeve 10*a* in such a manner that application of the predetermined magnitude of pressure 44 (FIG. 7C) to the on/off tool 2*a* compromises a mechanical connection between the top sub 2 and the tool spacer sleeve 10*a* and causes detachment of the on/off tool 2*a* from the tool spacer sleeve 10*a*.

As illustrated in FIG. 7D, under some circumstances it may be desirable to retrieve the assembly 1 from a hydrocarbon production well 17 (FIG. 9) in which the assembly 1 is deployed. Therefore, the on/off tool 2*a* can be detached from the stinger 22 typically in the conventional manner and lifted from the well 17 with the tool spacer sleeve 10*a* on a production string 28*a* (FIGS. 10-15) to which the assembly 1 is attached. As the on/off tool 2*a* travels upwardly with respect to the initially stationary tool spacer sleeve 10*a*, the tool lip 2*c* on the on/off tool 2*a* engages the sleeve lip 13*b* on the interior of the tool spacer sleeve 10*a*. Thus, the tool spacer sleeve 10*a* is suspended from the rising on/off tool 2*a* as the production string 28*a* carries the on/off tool 2*a* and the tool spacer sleeve 10*a* of the assembly 1 out of the well 17.

Figure 9:
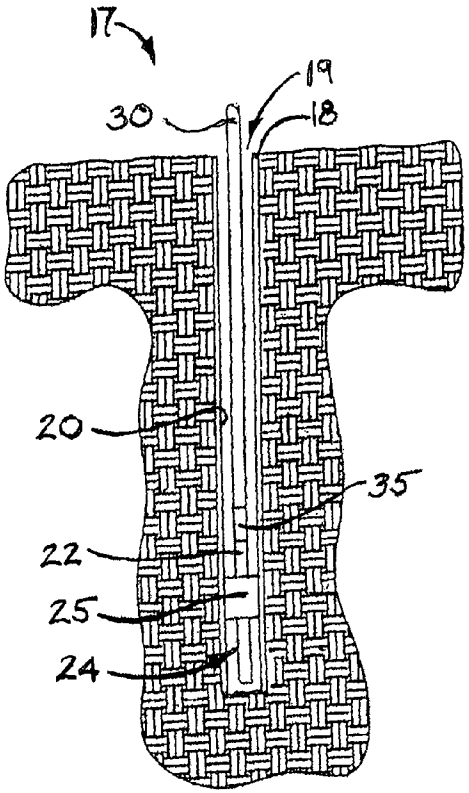
FIG. 9 is a schematic diagram which illustrates deployment of a packer in a well bore of a subterranean well casing according to an illustrative embodiment of the on/off tool running and well completion method.

Referring next to FIGS. 9-16 of the drawings, sequential implementation of an illustrative embodiment of the method is illustrated. As illustrated in FIG. 9, the hydrocarbon production well 17 may include a subterranean well casing 18 having a well bore 19. While the well casing 18 illustrated in FIG. 9 is vertical, in some applications the well casing 18 may be disposed in a horizontal or other non-vertical orientation. The packer 25 and packer stinger 22 may be deployed in the well bore 19 at a desired depth to isolate hydrocarbon production zones (not illustrated) from each other in the well bore 19 prior to completion of the well 17. Accordingly, the packer 25 may be deployed in the well bore 19, with the packer stinger 22 extending from the packer 25, using a hydraulic setting tool 35 provided on a wireline 30 or a tubing string 30 or the like, typically in the conventional manner.

Figure 10:
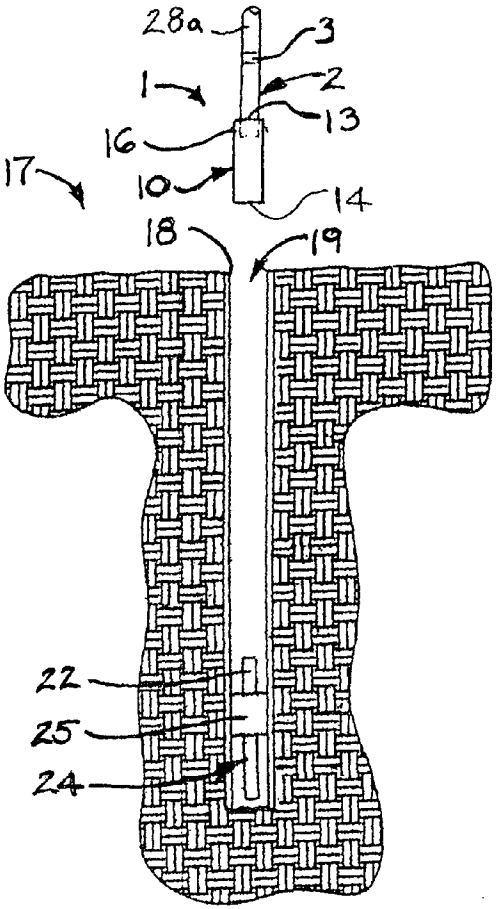
FIG. 10 is a schematic diagram which illustrates insertion of an on/off tool, attached to a production string (partially in section), and a tool spacer sleeve, attached to the on/off tool, into the well bore according to an illustrative embodiment of the on/off tool running and well completion assembly.

Upon subsequent retrieval of the wireline 30 from the well bore 19, the packer 25 and packer stinger 22 remain in the well bore 19, as illustrated in FIG. 10. The tool top sub 3 on the on/off tool 2*a* of the assembly 1 may be attached to a production string 28*a* via threading or other suitable method. The tool spacer sleeve 10*a* may be attached to the on/off tool 2*a* using the sleeve pin or pins 16, such as was heretofore described with respect to FIG. 7B, or suitable alternative attachment technique. In some embodiments, the production string 28*a* may be a conventional multi-segmented or jointed tubing string in which the production string 28*a* is assembled at the well surface by operation of a rotary table (not illustrated) typically in the conventional manner.

Figure 11:
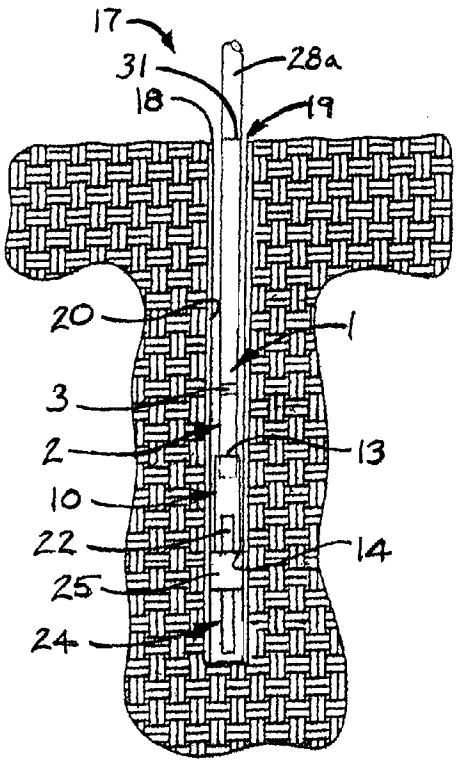
FIG. 11 is a schematic diagram which illustrates engagement of the tool spacer sleeve with the deployed packer and placement of a packer depth mark on the production string at the well surface to indicate the approximate the depth of the packer in the well bore on the tubing string.

As illustrated in FIG. 11, the production string 28*a* may be initially assembled at the well surface and inserted into the well bore 19 until the assembly 1 is proximate to the packer 25. In some embodiments, the production string 28*a* may be initially assembled and inserted into the well bore 19 until the tool spacer sleeve 10*a* of the assembly 1 reaches a selected proximity to the packer 25, after which further assembly and insertion of the production string 28*a* may be temporarily halted. Assembly and insertion of the production string 28*a* may then be resumed very slowly until the tool spacer sleeve 10*a* lightly tags the packer top sub 26 (FIGS. 1-4) of the packer 25. At that point, a packer depth mark 31 may be placed on the production string 28*a* at the surface level of the well bore 19 (or at some other reference level) to indicate the approximate depth of the packer 25 in the well bore 19. As the tool spacer sleeve 10*a* is lowered in place on the packer top sub 26, the spacer sleeve bore 12 (FIG. 7A) of the tool spacer sleeve 10*a* receives the packer stinger 22.

Figure 12:
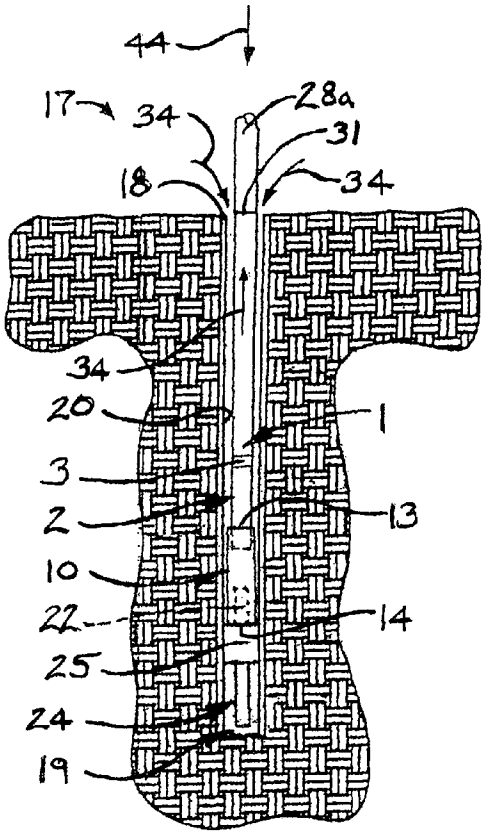
FIG. 12 is a schematic diagram which illustrates circulation of packer fluid through the well annulus, the tool spacer sleeve, the on/off tool and the production string, respectively, to the surface of the well bore to remove sediments from the packer top sub and the stinger of the packer preparatory to coupling the on/off tool to the packer.
Figure 16:
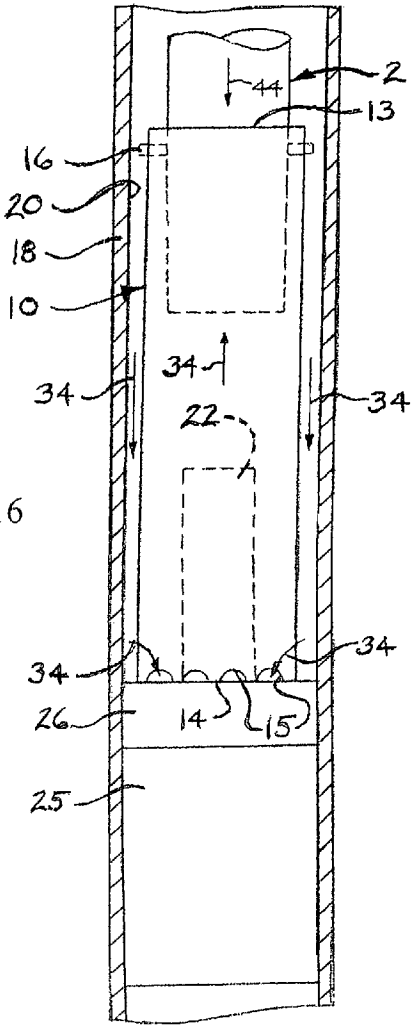
FIG. 16 is a partially schematic longitudinal sectional view illustrating the packer deployed in the well bore and the tool spacer sleeve attached to the on/off tool and engaging the packer, more particularly illustrating circulation of well circulation fluid from the well annulus through fluid flow notches in the lower end of the tool spacer sleeve, the interior of the tool spacer sleeve, the on/off tool and the production string (not illustrated) back to the well surface, respectively.

During deployment of the packer 25 in the well bore 19 (FIG. 9), sand, dirt and other sediments (not illustrated) may cover the packer top sub 26 and the packer stinger 22. Thus, as illustrated in FIG. 12, packer fluid 34 may be used to irrigate and clean the sediments from the packer top sub 26 and the packer stinger 22 before the on/off tool 2*a* is coupled to the packer stinger 22. Accordingly, as illustrated in FIG. 16, as the sleeve lower end 14 of the tool spacer sleeve 10*a* contacts the packer top sub 26 of the packer 25, the fluid flow notches 15 in the sleeve lower end 14 of the tool spacer sleeve 10*a* establish fluid communication between the well annulus 20 and the interior of the tool spacer sleeve 10*a*, the on/off tool 2*a* and the production string 28*a*. The packer fluid 34 may next be circulated from the well surface downwardly through the well annulus 20 and the fluid flow notches 15 and then upwardly through the tool space sleeve 10, the on/off tool 2*a* and the production string 28*a* back to the well surface, respectively. As it flows through the fluid flow notches 15 and upwardly through the tool space sleeve 10, the packer fluid 34 cleans the sediments (not illustrated) from the surface of the packer sub 26 and the stinger 22.

As further illustrated in FIG. 12, throughout circulation of the packer fluid 34, downward pressure 44 may be applied to the tool spacer sleeve 10*a* via the production string 28*a* and the on/off tool 2*a* to ensure that the packer fluid 34 contacts and substantially removes the sediments from the packer top sub 26. In some embodiments, the downward pressure 44 may have a magnitude of about 1~4000 lbs, although pressures which are greater than 4000 lbs. may be used in some applications. Therefore, the sleeve pins 16 (FIG. 7B) or other attachment mechanism which attaches the on/off tool 2*a* to the tool spacer sleeve 10*a* may have a shear strength which is greater than the downward pressure 44 to withstand pressurization of the production string 28*a* during circulation of the packer fluid 34.

Figure 13A:
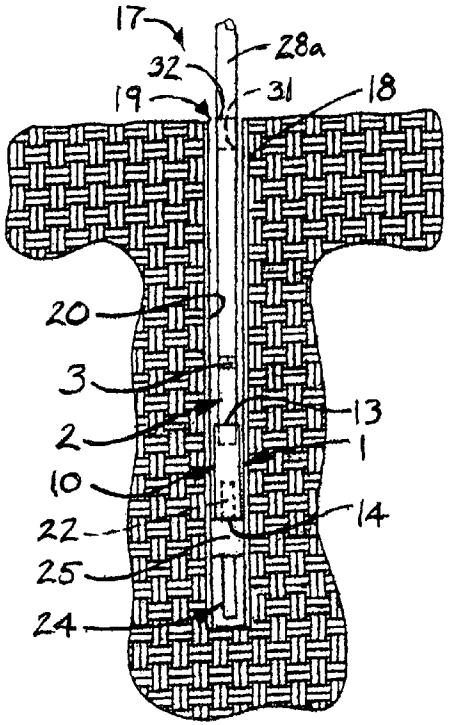
FIG. 13A is a schematic diagram which illustrates placement of an adjusted packer depth mark on the tubing string at the surface level of the well bore after circulation of the packer fluid is completed.

As illustrated in FIG. 13A, upon conclusion of the packer fluid circulation operation (FIG. 12), the position of the packer depth mark 31 which was previously made on the production tubing 28 (FIG. 11) on the tubing string 30 relative to the surface of the well bore 19 or other reference level may be checked since circulation of the packer fluid 34 may have removed sediments from the top of the packer 25 and caused the production string 28*a* to settle in the well bore 19. In the event that the original packer depth mark 31 falls below the surface of the well bore 19 or other reference level due to settling of the production string 28*a*, the packer depth mark 31 may be erased and an adjusted packer depth mark 32 may be placed on the production string 28*a* at the well bore surface or other reference level to more accurately indicate the depth of the packer 25 in the well bore 19 on the production string 28*a*.

Figure 13B:
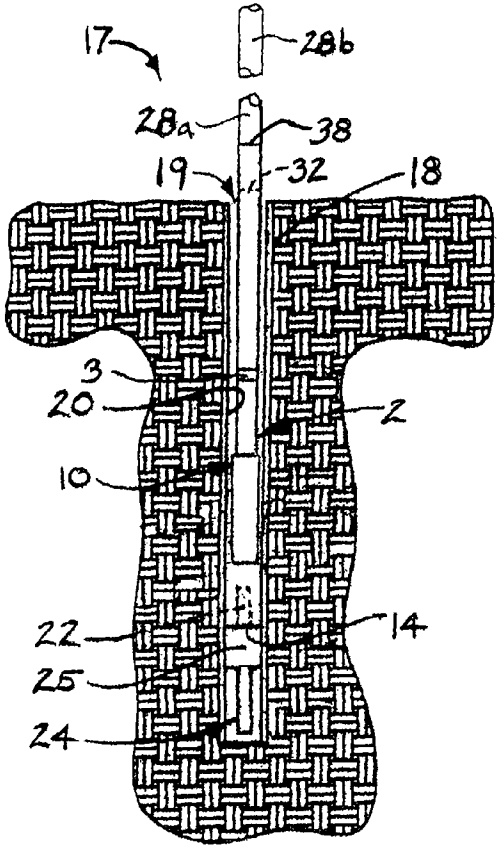
FIG. 13B is a schematic diagram which illustrates partial removal of the production string from the well bore and placement of a final packer depth mark on the production string, taking into account tubing compression, "space out" of production string subs and stroke of the on/off tool, to indicate the depth of the packer in the well bore.

Prior to latching the on/off tool 2*a* to the packer stinger 22, it may be necessary to determine the length of the production string 28*a* which is required to land the on/off tool 2*a* on the packer stinger 22. Thus, the length of the production string 28*a* which is necessary to lightly land the on/off tool 2*a* on the packer stinger 22 may be calculated. Accordingly, as illustrated in FIG. 13B, some of the top tubing, joints 28*b* may be disassembled from the top of the production string 28*a* to raise the assembly 1 from the top packer sub 26 of the packer 25. The required length of the production string 28*a* is then calculated, the calculated length of the production string 28*a* taking into account desired tubing compression due to the depth of the packer 25 in the well bore 19, "space out" of subs and other tubing string elements in the production string, 28*a* and the stroke distance of the on/off tool 2*a* through the tool spacer sleeve 10*a* as it is displaced from the pinned position (FIG. 7B) to the landed or latched position on the packer stinger 22. These calculations may be made using tubing compression and space-out calculation methods which are known by those skilled in the art. When the required length of the production string 28*a* has been calculated, a final packer depth mark 38 may be made on the production string 28*a*. The final packer depth mark 38 may correspond to the level of the surface of the well bore 19 or other reference level when the on/off tool 2*a* lands on the packer stinger 22.

Figure 14:
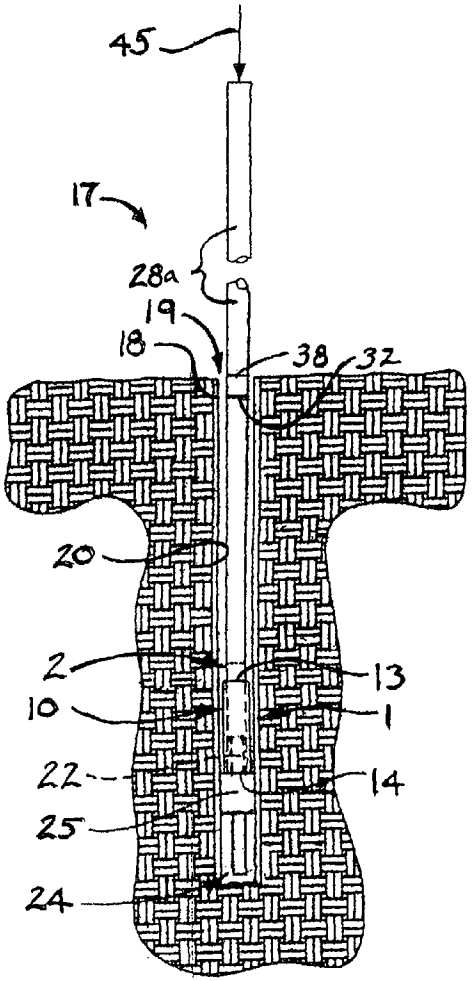
FIG. 14 is a schematic diagram which illustrates downward pressurization of the production string in the well bore to shear the connection between the on/off tool and the tool spacer sleeve and couple the on/off tool to the packer.

As illustrated in FIG. 14, the production string 28*a* may be assembled and inserted into the well bore 19 initially until the adjusted packer depth mark 32 reaches the surface of the wellbore 19 or other reference level, thus indicating that the tool spacer sleeve 10*a* has landed on the packer top sub 26 of the packer 25. Next, a sufficient magnitude of downward pressure 45 is applied to the production string 28*a* to shear the sleeve pins 16 (FIG. 7B) or other attachment mechanism which attaches the on/off tool 2*a* the tool spacer sleeve 10*a*. As the location of the final packer depth mark 38 is noted, the production string 28*a* is slowly inserted into the well bore 19 until the final packer depth mark 38 reaches the surface of the well bore 19 or other reference level, thus indicating that the on/off tool 2*a* has landed on and latched to the packer stinger 22.

Figure 15:
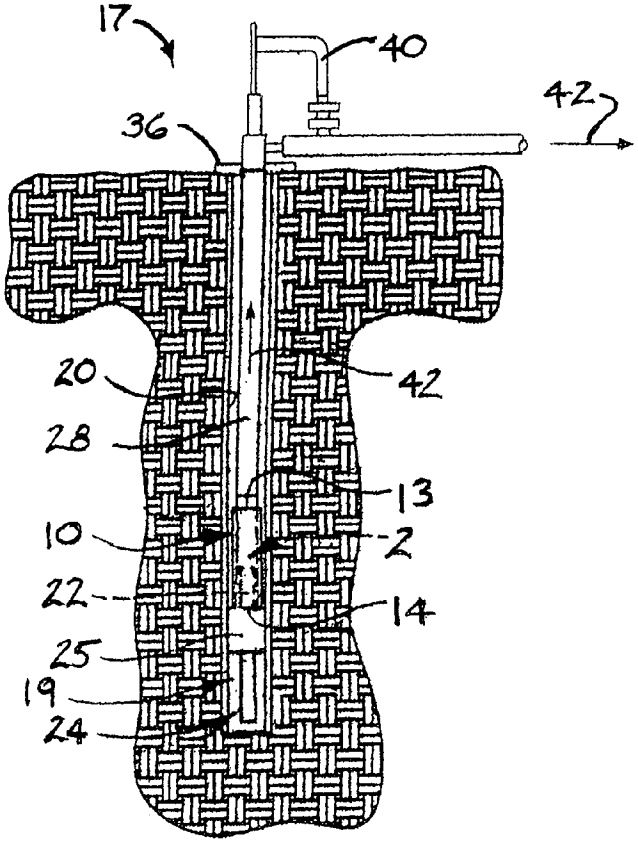
FIG. 15 is a schematic diagram which illustrates a Christmas tree assembled on the completed well and production of hydrocarbons from the tubing string through the Christmas tree.

The production string 28*a* may be pulled upwardly in the well bore 19 and then slacked to ensure that the on/off tool 2*a* has been latched to the packer stinger 22. As illustrated in FIG. 15, the production string 28*a*, suspended from a tubing hanger 36, may be installed typically in the conventional manner. The well annulus 20 and the production string 28*a* may be tested to ensure a proper seal imparted by the seal pack 50 (FIG. 6) between the inner surface of the on/off tool 2*a* and the outer surface of the packer stinger 22. A Christmas tree 40 may be installed to facilitate production of hydrocarbons 42 from the well bore 19 typically in the conventional manner.

After the hydrocarbon production zone which is serviced by the production string 28*a* has been depleted or in the event that the well 17 requires service, the assembly 1 may be removed from the well bore 19 and the method may be repeated with respect to another hydrocarbon production zone in the well 17. As illustrated in FIG. 7D and was heretofore described, it will be appreciated by those skilled in the art that upon retrieval of the production string 28*a* from the well bore 19, the sleeve lip 13*b* on the tool spacer sleeve 10*a* engages the pin seat or pin seats 6 in the stinger connection portion 5 of the on/off tool 2*a*. Thus, the tool spacer sleeve 10*a* may be suspended from the on/off tool 2*a* and carried out of the well bore 19 with the on/off tool 2*a* as the production string 28*a* is extracted from the well bore 19.

It will be appreciated by those skilled in the art that the on/off tool running and well completion method facilitates coupling of a production string 28*a* to a packer 25 once without the need to repeatedly tag the packer stinger 22 with the on/off tool 2*a* (in which the seal pack 50 is installed) during the tubing string latching and marking operation. Consequently, the structural integrity of the on/off tool 2*a*, the packer stinger 22 and the seals in the seal pack 50 is substantially preserved since damage or abrasion to these elements by sediments is prevented or minimized. This results in substantial cost savings which may otherwise be required in repair or replacement of the on/off tool 2*a*, the packer stinger 22 and/or the seal pack 50, as well as enhanced sealing capability of the seal pack 50 between the interior surface of the on/off tool 2*a* and the exterior surface of the packer stinger 22.

While illustrative embodiments of the disclosure have been described above, it will be recognized and understood that various modifications can be made and the appended claims are intended to cover all such modifications which may fall within the spirit and scope of the disclosure.

What is claimed is:

1. An on/off tool running and well completion method, comprising:

deploying a packer in a well bore;

providing an assembly having an on/off tool and a tool spacer sleeve carried by said on/off tool;

providing a tubing string;

coupling said on/off tool of said assembly to said tubing string;

inserting said assembly and said tubing string in said well bore until said tool spacer sleeve tags said packer;

irrigating said packer by circulating packer fluid through said well bore, said assembly and said tubing string to clean said packer as said tool spacer sleeve remains attached to said on/off tool;

removing said tool spacer sleeve from said packer;

calculating a length of the tubing string required to land said on/off tool on said packer;

inserting said assembly and said tubing string in said well bore until said tool spacer sleeve lands on said packer; and latching said on/off tool of said assembly to said packer once by pressurizing said tubing string, detaching said tool spacer sleeve from said on/off tool, displacing said on/off tool through the tool spacer sleeve and landing said on/off tool onto said packer.

2. The method of claim 1 further comprising determining a depth of said packer in said well bore.

3. The method of claim 1 wherein said providing an assembly comprises providing said assembly having said on/off tool and said tool spacer sleeve carried by said on/off tool via at least one breakable connection.

4. The method of claim 3 wherein said providing an assembly comprises providing said assembly having said on/off tool and said tool spacer sleeve carried by said on/off tool via at least one sleeve pin.

5. The method of claim 3 wherein said providing an assembly comprises providing said on/off tool and said tool spacer sleeve telescopically receiving said on/off tool.

6. The method of claim 5 further comprising determining a depth of said packer in said well bore by tagging said packer with said tool spacer sleeve of said assembly.

7. The method of claim 3 wherein said latching said on/off tool of said assembly to said packer comprises breaking said at least one breakable connection.

8. The method of claim 7 wherein said providing an assembly comprises providing an assembly having an on/off tool and a tool spacer sleeve having at least one fluid flow notch carried by said on/off tool, and wherein said irrigating said packer comprises circulating said packer fluid through said well bore, said at least one fluid flow notch, said tool spacer sleeve, said on/off tool and said tubing string, respectively.

9. The method of claim 7 wherein said determining a length of the tubing string required to land said on/off tool on said packer comprises calculating a length of said tubing string in said well bore based on compression of said tubing string due to said depth of said packer in said well bore, space out of subs in said tubing string and displacement of said on/off tool in said tool spacer sleeve.

10. An on/off tool running and well completion method, comprising:

deploying a packer having a packer stinger in a well bore;

providing an assembly having an on/off tool, a seal pack in said on/off tool, a tool spacer sleeve telescopically receiving said on/off tool and at least one breakable connection normally securing said on/off tool and said tool spacer sleeve in stationary relationship to each other;

providing a tubing string;

coupling said on/off tool of said assembly to said tubing string;

inserting said assembly and said tubing string in said well bore until said tool spacer sleeve tags said packer;

irrigating said packer by circulating packer fluid through said well bore, said tool spacer sleeve and said on/off tool of said assembly and said tubing string, respectively, to clean said packer as said tool spacer sleeve remains attached to said on/off tool at said at least one breakable connection;

determining a depth of said packer in said well bore;

placing a packer depth mark corresponding to said depth of said packer on said tubing string;

removing said tool spacer sleeve from said packer;

calculating a length of said tubing string in said well bore required to land said on/off tool on said packer based on compression of said tubing string due to said depth of said packer in said well bore, space out of subs in said tubing string and displacement of said on/off tool in said tool spacer sleeve;

inserting said assembly and said tubing string in said well bore until said tool spacer sleeve lands on said packer; and latching said on/off tool of said assembly to said packer stinger of said packer once by pressurizing said tubing string, detaching said tool spacer sleeve from said on/off tool at said at least one breakable connection, displacing said on/off tool through the tool spacer sleeve and landing said on/off tool onto said packer.

11. The method of claim 10 further comprising determining an initial depth of said packer in said well bore prior to said irrigating said packer and placing an initial packer depth mark on said tubing string corresponding to said initial depth of said packer in said well bore.

12. The method of claim 10 wherein said providing an assembly comprises providing an assembly having at least one sleeve pin normally securing said on/off tool and said tool spacer sleeve in stationary relationship to each other.

13. The method of claim 9 wherein said providing an assembly comprises providing an assembly having an on/off tool and a tool spacer sleeve having at least one fluid flow notch telescopically received by said on/off tool, and wherein said irrigating said packer comprises circulating said packer fluid through said well bore, said at least one fluid flow notch, said tool spacer sleeve, said on/off tool and said tubing string, respectively.

14. The method of claim 13 wherein said providing an assembly comprises providing an assembly having a generally elongated, cylindrical sleeve wall with a spacer sleeve first end and a spacer sleeve second end, a spacer sleeve bore traversing said sleeve wall from said spacer sleeve first end to said spacer sleeve second end and a sleeve lip protruding from said sleeve wall into said spacer sleeve bore generally at said spacer sleeve first end, and wherein said at least one fluid flow notch is provided in said spacer sleeve second end.

* * * * *